US006358465B1

(12) United States Patent
Paulus

(10) Patent No.: US 6,358,465 B1
(45) Date of Patent: Mar. 19, 2002

(54) DEVICE FOR EXCHANGING HEAT WITH A FLAT PRODUCT

(75) Inventor: Philippe Paulus, Trooz (BE)

(73) Assignee: Selas SA (FR)

( * ) Notice: Subject to any disclaimer, the term of this patent is extended or adjusted under 35 U.S.C. 154(b) by 0 days.

(21) Appl. No.: 09/504,140

(22) Filed: Feb. 15, 2000

(30) Foreign Application Priority Data

Feb. 16, 1999 (FR) ..... 99 01851

(51) Int. Cl.[7] ..... C21D 9/56
(52) U.S. Cl. ..... 266/111; 266/46
(58) Field of Search ..... 266/46, 111, 103

(56) References Cited

U.S. PATENT DOCUMENTS 3,262,688 A 7/1966 Beggs
5,871,686 A * 2/1999 Nivoche ..... 266/46

FOREIGN PATENT DOCUMENTS

EP 08008254 1/1996
EP 0 761 829 A1 12/1997
FR 2738577 * 11/1997

* cited by examiner

*Primary Examiner*—Scott Kastler
(74) *Attorney, Agent, or Firm*—Vanophem & Vanophem, P.C.

(57) ABSTRACT

A device for exchanging heat with a flat product moving in front of the device that includes a device for placing at least one plenum chamber under gaseous pressure, the plenum chamber having on a front face several blades forming a duct for the ejection of the gas towards a surface of the flat product, the blades being superimposed upon one another in the direction of movement of the flat product and constituting an outlet orifice for the gas extending in the direction of the width of the flat product. The plenum chamber has a width in the direction of the width of the flat product sufficient to allow the evacuation of the gas on both sides of the plenum chamber.

14 Claims, 6 Drawing Sheets

DEVICE FOR EXCHANGING HEAT WITH A FLAT PRODUCT

BACKGROUND OF THE INVENTION

1. Field of the Invention

The present invention relates to a device for exchanging heat with a flat product.

It is more particularly applicable to any flat product, in strip or sheet form, or even one formed from a layer of parallel wires.

It relates more particularly to the field of heat treatment of rolled products, such as a rolled metal, which pass over rollers and successively traverse heat treatment chambers. Such annealing or galvanizing lines are used continuously, for example in the manufacture of steel sheets for motor car bodywork. The steel can be raised to temperatures which can reach 600–900° C. A rapid and uniform cooling of these products is then necessary in order to bring the temperature of the product down to a temperature below 500° C. depending on the desired quality.

2. Description of the Related Art

According to the prior art, a heat exchange device such as described in French patent FR 2,738,577 in the name of the Applicant, makes it possible to continuously cool a rolled product passing in front of a series of blades that form ducts for the ejection of a cooling gas.

French patent FR 2,738,577 discloses a device for placing a plenum chamber under gaseous pressure. The plenum chamber includes, on a front face thereof, several blades that form a duct for the ejection of the gas towards a surface of the rolled product, the blades being superimposed upon one another along the direction of movement of the rolled product and constituting an outlet orifice for the gas extending over the width of the rolled product.

Each space separating two superimposed blades has a depth in a direction perpendicular to the surface of the rolled product and a width in the longitudinal direction of the rolled product sufficient to allow the evacuation of gases without disturbing the gas outlet of the adjacent blades.

Thus, the space provided between the blades facilitates the evacuation of the gas at the level of the surface of the rolled product and does not impede the emission of gas coming out of the orifice of the blades.

In fact, if no precaution is taken to evacuate the hot gases after their impact on the product then, as the gas flow is increased, the heat transfer coefficient, and therefore the cooling speed, ceases to grow and a "saturation" effect then occurs. This phenomenon is described, for example, in the article by C. Brugnera et al., Revue de Métallurgie, December 1992, page 1098, FIG. 8, where it can be seen that above 500 mm of column of water (CE) of pressure at the orifice, the cooling speed no longer increases, even on increasing the pressure to 800 mm CE.

In the case of French patent FR 2,738,577, in order to totally prevent the formation of a layer of hot gas on the surface of the rolled product, the space between the blades must be dimensioned such that the return speed of the gases is less than 20 m/s, which makes it necessary, if the gas is taken off laterally on only one side, for the ratio of the sum of the half-flows of two superimposed blades (that is to say the flow of one blade) at the section of passage between two blades to be less than 20. If the product to be treated is wide and the blade is in one piece in the direction of the width of the product, and if in addition the required transfer coefficient is high, blade depths that are excessive and difficult to install must be provided.

The purpose of the present invention is to improve such a heat exchange device, and in particular to facilitate the evacuation of the gas out of the device after its impact on a flat product.

BRIEF SUMMARY OF THE INVENTION

The invention thus relates to a device for exchanging heat with a flat product, moving in front of the device, that is provided with a device for placing at least one plenum chamber under gaseous pressure. The plenum chamber has, on a front face thereof, several blades forming a duct for the ejection of the gas towards a surface of the flat product, with the blades being superimposed upon one another in the direction of movement of the flat product and constituting an outlet orifice for the gas extending in the direction of the width of the flat product.

According to the invention, the heat exchanger device is characterized in that the plenum chamber has a width in the direction of the width of the flat product that allows the evacuation of the gas towards the rear on both sides of the plenum chamber.

Because of the reduced width of the gaseous pressurizing plenum chamber, the evacuation of gases after impact on the surface of the flat product can be carried out on both sides of the plenum chamber, contrary to the blades forming a gas duct on the front face of the plenum chamber.

The flow of the exiting gas is consequently directed towards the rear of the device, without impeding the emission of the gas through the orifices of the blades. Any risk of stagnation of the gas on the surface of the treated product is thus carefully avoided, just as is any current of gas parallel with the surface to be processed both in the direction of the width and in that of the movement of the product.

In a practical and advantageous manner, the width of the plenum chamber is less than the width of the outlet orifice of the gas extending in the width of the flat product.

In other words, each blade thus widens towards the flat product so that the gas, after impact on the flat product, can return towards the rear of the device, on each side of the plenum chamber.

According to a preferred characteristic of the invention, the heat exchanger device includes openings for the outlet of the gas after ejection that are situated in a plane defined by a rear face opposite the front face of the plenum chamber.

The evacuation at the rear of the plenum chamber makes it possible to avoid any movement of gas along the surface of the flat product such as is produced in the conventional devices in which the plenum chambers are continuous or disposed side by side and prevent the return of the cooling gases towards the rear. Unlike the prior devices in which the evacuation of gases is carried out on the sides of the device, the gas can be evacuated from the heat exchanger device according to the invention without generating a preferential cooling of the edges of the flat product.

According to a preferred characteristic of evacuation, the heat exchanger device embodies at least two plenum chambers disposed in the width of the flat product, the spacing between the plenum chambers being such that the evacuation of the gas between the plenum chambers is carried out at a speed of less than or equal to 20 m/s.

In this way a regular evacuation of the gas towards the rear of the device is ensured, without risk of formation of turbulence that could be prejudicial to the homogeneity of the heat exchanges.

According to an advantageous and practical characteristic of the invention, the ratio between half of the gas flow in m3/s at the outlet of two adjacent blades along the width the product and the section in m2 of the space separating the plenum chambers having the blades is less than 20, the section extending in a plane parallel with the flat product and in the direction of movement of the flat product.

According to another preferred characteristic of the invention, the ratio between the speed of the gas in a plenum chamber and the speed of the gas at the outlet of the blades integral with the plenum chamber is less than 0.2.

Because of this large difference in the speed of the gas in the plenum chamber and at the outlet of the blades, the plenum chamber forms a reservoir of gas under pressure that is virtually without circulation, ensuring a uniform speed for the ejection of gases.

According to another preferred characteristic of the invention, the device for placing the plenum chamber under gaseous pressure embodies several fans adapted to supply gas to one or more plenum chambers.

The pressure of each plenum chamber can thus the regulated independently or in sub-groups of plenum chambers, making it possible to adjust, over the width of the flat product, the cooling rate according to the desired thermal profile.

Other features and advantages of the invention will be apparent when taken in conjunction with the following description and accompanying drawings.

DETAILED DESCRIPTION OF THE INVENTION

A flat product cooling device which is formed from a heat exchanger device according to the invention will be described below by way of example.

It will, of course, also be possible to apply the invention to a device for heating a flat product.

Figure 1:
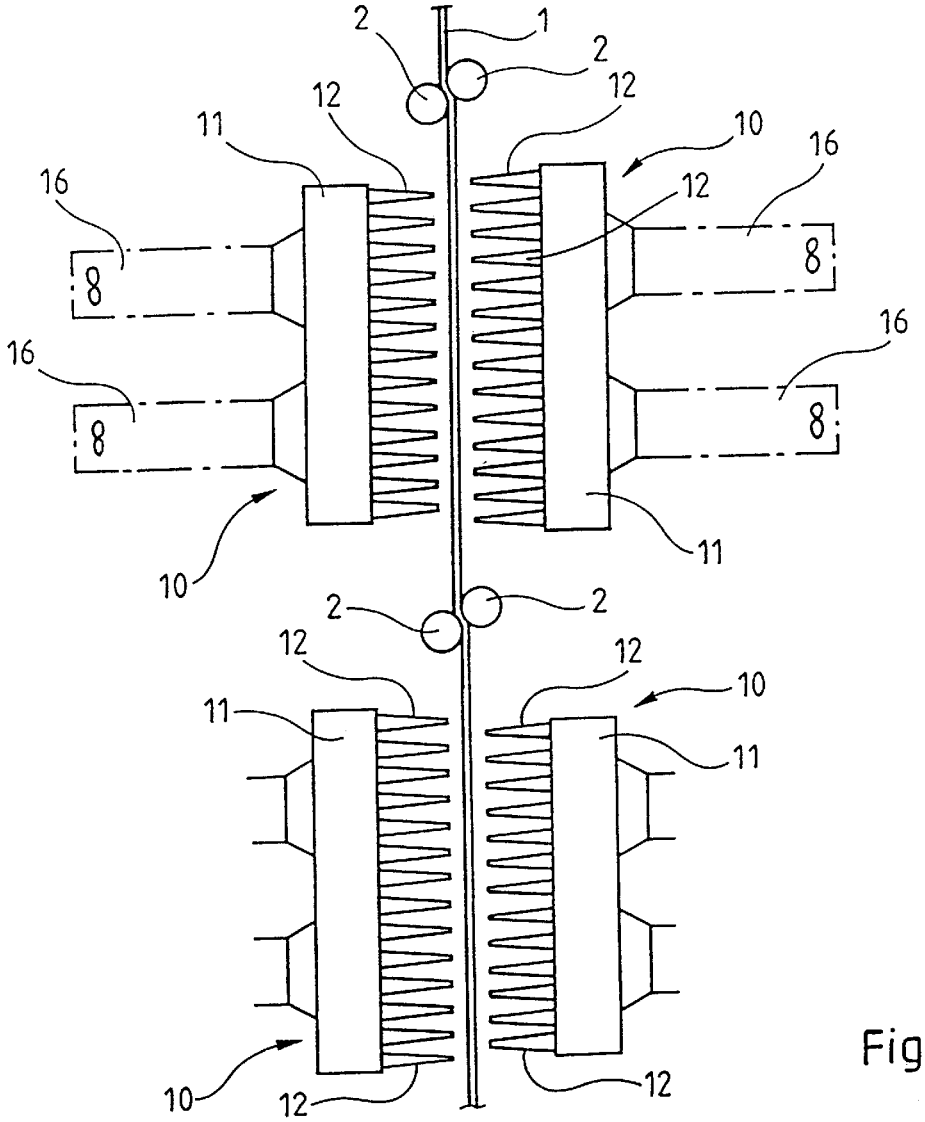
FIG. 1 is a schematic view of a cooling installation embodying cooling devices according to the invention.

With reference to FIG. 1, an installation for the continuous cooling of a flat product such as a rolled product 1 can embody several cooling or heat exchanger devices 10, four of them in this case, distributed over the path of the rolled product moving between conveying rollers 2. In a non-limitative manner, the rolled product moves vertically between the cooling devices 10 generally disposed in pairs on each side of the rolled product in order to cool the product simultaneously on both of its faces.

The conveying rollers 2 make it possible to stabilize the rolled product 1. They can cause a slight deflection of the rolled product 1, of less than or equal to 15° in order to limit the vibration of the rolled product 1.

Such a cooling installation can be used, for example, in a continuous annealing line for the treatment of steel strips, in which the rolled product moves in vertical passes in different treatment chambers.

The steel strips have a thickness of between 0.15 and 2.3 mm and their width can be up to 2 m.

It is important during the heat treatment of steel to cool the strips very quickly and in a homogeneous manner in order to avoid any distortion of the strip.

In order to do this, the cooling device 10 has plenum chambers 11 that are adapted to contain a gas under pressure.

Each plenum chamber 11 includes several blades 12 which form ducts for the ejection of the gas towards the rolled product 1 to be cooled.

The blades 12 are superimposed upon one another as illustrated in FIG. 1, in the direction of movement of the rolled product 1, in such a way as to cool the surface of the product during its travel in the heat exchanger device 10.

The height of the stack of blades 12 over the height of a plenum chamber 11 is preferably less than or equal to 6 m.

Figure 2:
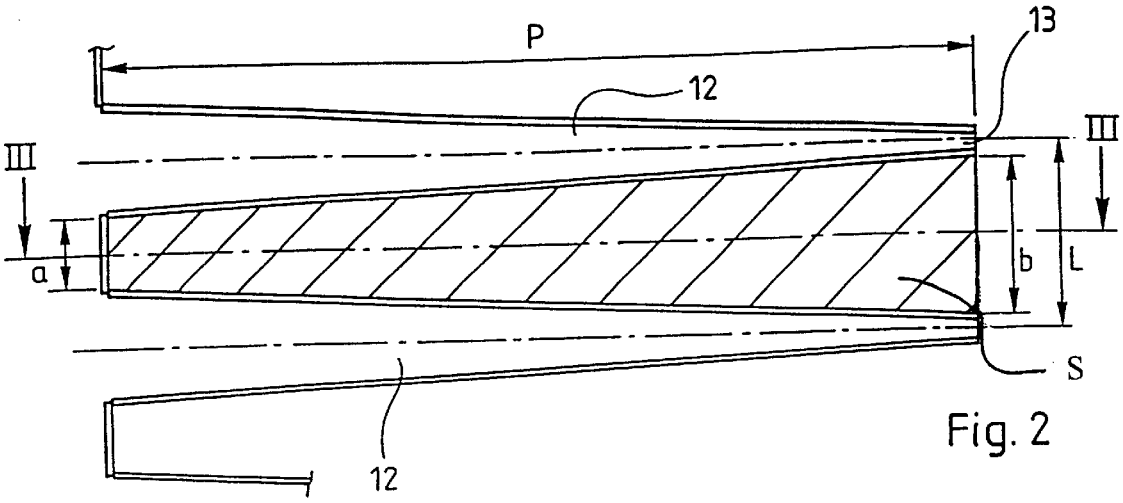
FIG. 2 is a schematic side view of two superimposed blades of a heat exchanger device according to the invention.

The blades 12 include at least one outlet orifice 13 as shown in FIG. 2, which extends in the width of the rolled product 1. This outlet orifice 13 thus emerges at the end of the duct formed by the blade 12 which extends from the plenum chamber 11 towards the rolled product 1.

Preferably, the cross section of the blades 12, in a plane perpendicular to the rolled product 1, decreases starting from the plenum chamber 11.

The outlet orifices 13 can be holes that are circular, rectangular or oblong, etc. or they can be small slots formed at the end of each blade 12. The blade 12 could also have only one single outlet orifice 13 forming a slot facing the rolled product 1.

Each space or section separating two superimposed blades 12 (cross-hatched in FIG. 2) has a depth in the direction perpendicular to the rolled product 1 and a width in the longitudinal direction of the rolled product 1 that are sufficient to prevent the accumulation of the cooling gas close to the surface of the rolled product 1.

The depth of the spaces separating the blades 12 is thus greater than 200 mm, and preferably greater than 300 mm.

The arrangement of the blades 12 and of their orifices 13 is described in particular in the above-mentioned French patent FR 2,738,577.

More generally, the number of blades 12 of the heat exchanger device 10 and the number of outlet orifices 13 are such that the total section formed by the outlet orifices 13 is between 1% and 5% of the area covered by all of the blades 12, and preferably between 2 and 4% of this area.

Furthermore, the blades 12 of the plenum chamber 11 are dimensioned such that the evacuation of the gas in the section S between these blades 12 is carried out at a speed of less than or equal to 20 m/s at all points.

The section corresponds to the section of the space taken in the plane of FIG. 2, perpendicular to the rolled product 1 and parallel with the direction of moment of the rolled product 1.

The speed of the gas after its impact on the product is thus maintained, in the spaces between the blades 12, below a critical value of 20 m/s in order to limit turbulence phenomena in these spaces which would disturb the evacuation of the gas.

More precisely, the section of passage between two superimposed blades 12 is equal to the product of the depth P of that space between two blades 12 and the average free height W between two blades 12.

$$W=(a+b)/2$$

where a is equal to the distance separating the blades 12 at the level of the front face of the plenum chamber 11, and b is equal to the distance separating the blades 12 at the level of the outlet orifices 13.

Figure 3A:
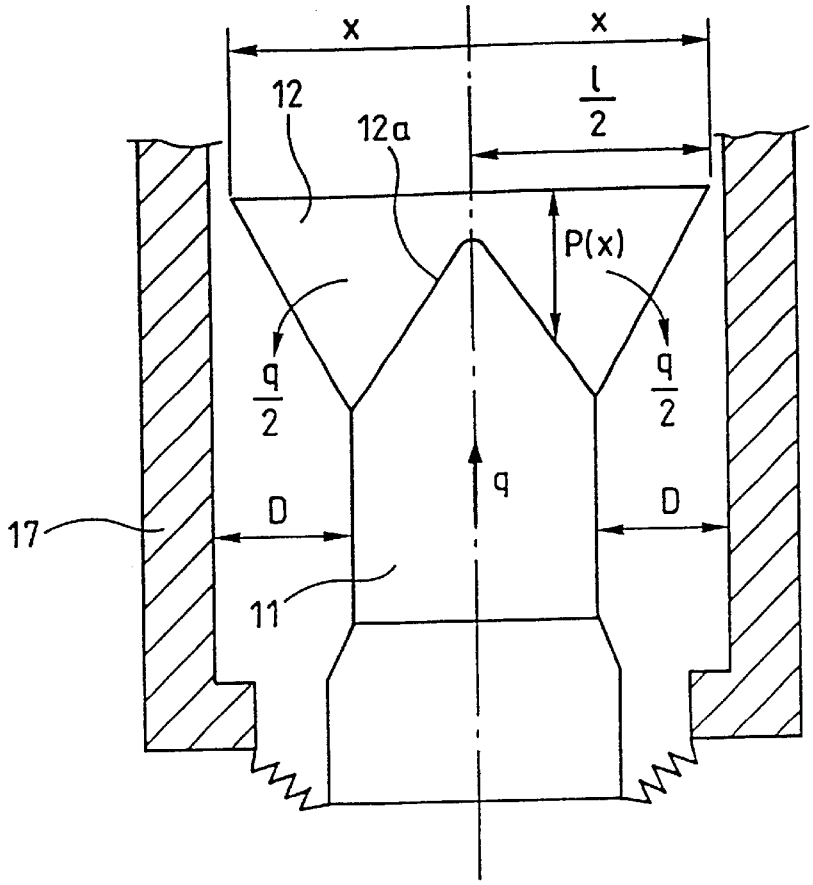
FIGS. 3A and 3B are schematic cross-sectional views of examples of blades, taken along lines III—III of FIG. 2.
Figure 3B:
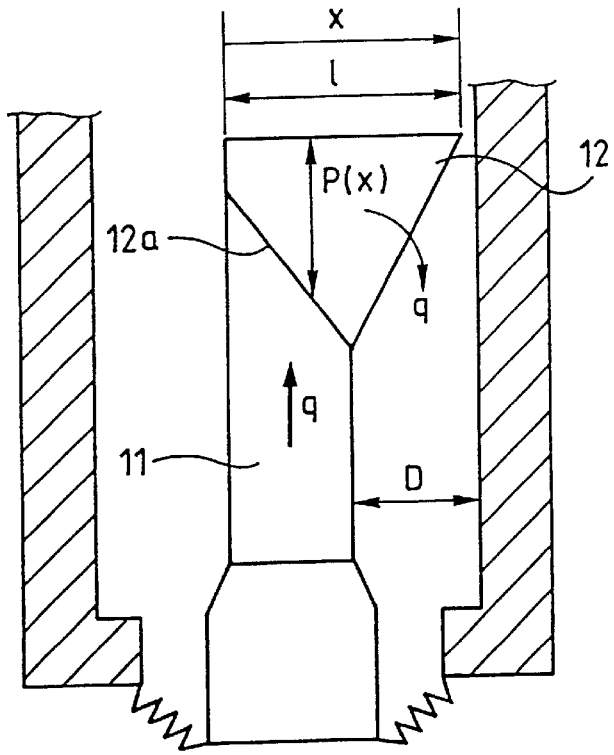

The depth P can be constant in the width of the blade 12, or variable, as shown in FIGS. 3A and 3B, if it is desired to confer a greater speed on the return gas current towards the rear of the device.

A partition 12*a* thus extends between the superimposed blades 12, starting from the plenum chamber 11, such that the depth P in the center of the blade 12 is smaller than at its ends.

In general, the depth is a continuous function P(x) which varies with the distance x from the axis of symmetry of the blade 12 (in the case of FIG. 3A where a symmetrical return of the gas is produced on both sides) or from the end of the blade 12 (in the case of FIG. 3B where the return of the gas is carried out on only one side of the blade).

In the case of FIG. 3A, the flow between two blades 12 at a distance x from the axis of symmetry is equal to q.x/l, where q is the flow per blade (m3/s) and l is the width of the end of the blade 12 parallel with the width of the product with $x \leqq ½$. The section of passage for the return gas at the same distance x is equal to w.P(x). The limitation of the return speed to 20 m/s therefore implies that, for any value of x between 0 and ½, the following applies:

$$P(x) \geqq q.x/20/l/w,$$

x, l and w being expressed in meters.

Similarly, in the case of FIG. 3B, the condition is also:

$P(x) \geqq q.x/20/l/w$, x varying this time between 0 and 1.

In this way, the gas escaping between the blades can be evacuated at both ends of the latter in the case of FIG. 3A, which means that the limit extraction speed is reached only when the flow q/2 of a half-width of blade divided by the section S of passage between two blades is equal to 20, that is to say q/S=40.

In comparison with French patent FR 2,738,577, extracting the gas on both sides of the blade therefore makes it possible to reduce the section to S=q/40 instead of q/20.

Figure 4:
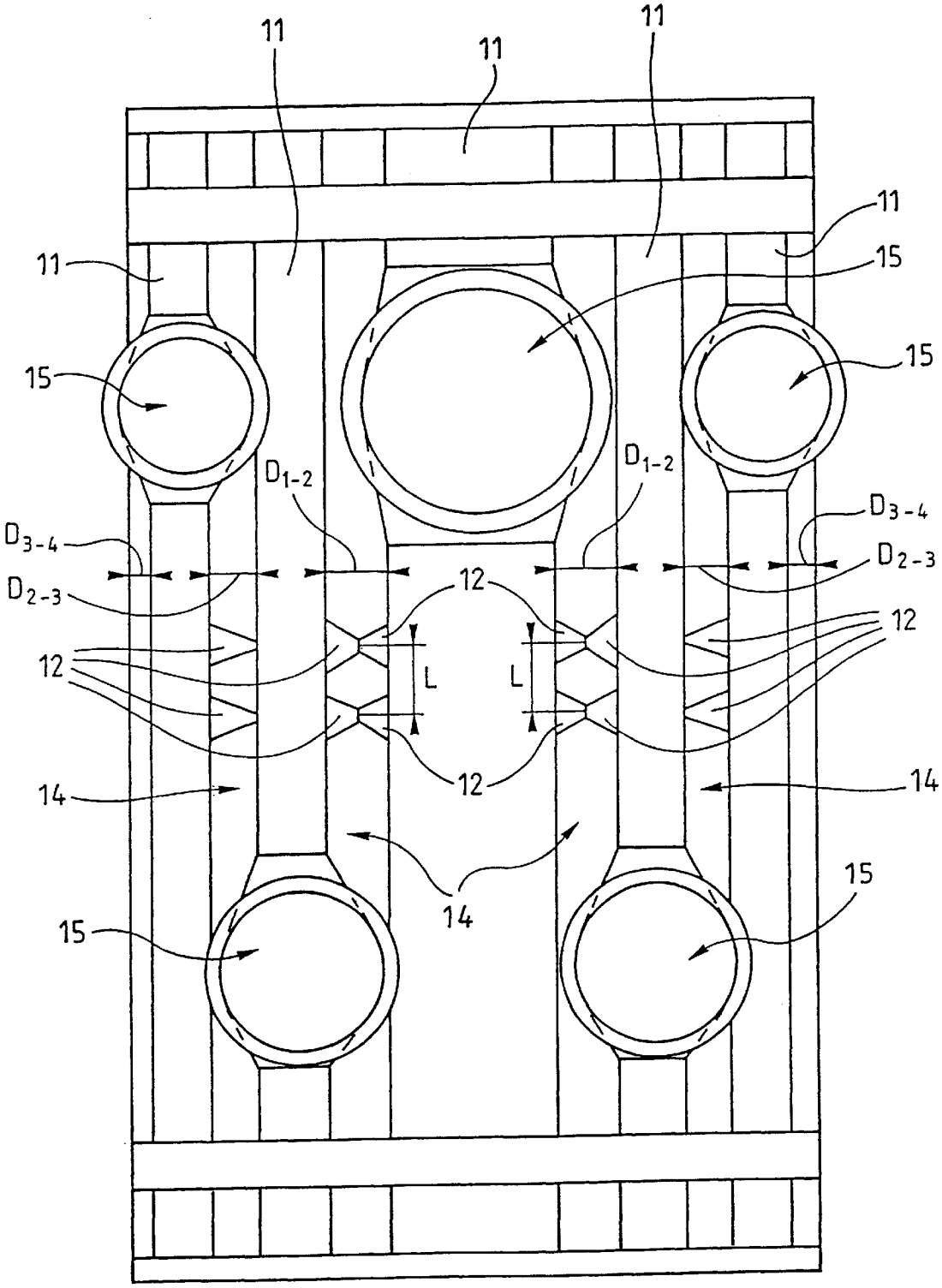
FIG. 4 is a rear view of a heat exchanger device according to one embodiment of the invention.

As shown in FIG. 4, and according to the invention, the cooling device has at least one plenum chamber 11, and five of them in the example of FIG. 4. The plenum chambers 11 are distributed over the width of the rolled product 1 and extend in the longitudinal direction of the moving rolled product, parallel with one another.

The width of each plenum chamber 11 and the distance separating the plenum chambers 11 allow the evacuation of the gas between the plenum chambers 11 without disturbing the outlet of gas from the blades 12.

This distance, referenced D1-2 or D2-3 in FIG. 4, can have a value that differs from one pair of plenum chambers 11 to another.

In this example, the plenum chambers 11 have a substantially parallelepipedic section, the distance between the plenum chambers 11 corresponding to the distance separating their sides placed facing one another.

Outlet openings 14 for the gas after ejection are thus situated between the plenum chambers 11, in a plane defined by the rear faces opposite to the front faces of the plenum chambers 11.

The gas can thus be retrieved on a rear face of the heat exchanger device 10, opposite to the rolled product 1, which makes it possible to avoid the circulation of gas along the surface of the rolled product 1 and allows greater cooling at the edges of the rolled product 1 than at its center.

Preferably, the ratio between half the gas flow in m/s at the outlet of two adjacent blades 12 in the direction of the width of the product to the section in $m^2$ of the space separating the plenum chambers 11 embodying the blades 12 is less than 20.

This section, taken in the plane of FIG. 4, extends in a plane parallel with the rolled product 1 and in the direction of movement of the rolled product 1.

It corresponds, in the plane of the front faces of the plenum chambers 11, to the product of the distance L (pitch or inter-axis distance) separating two superimposed blades 12 and the distance D1-2 or D2-3 separating two adjacent plenum chambers 11.

Figure 6:
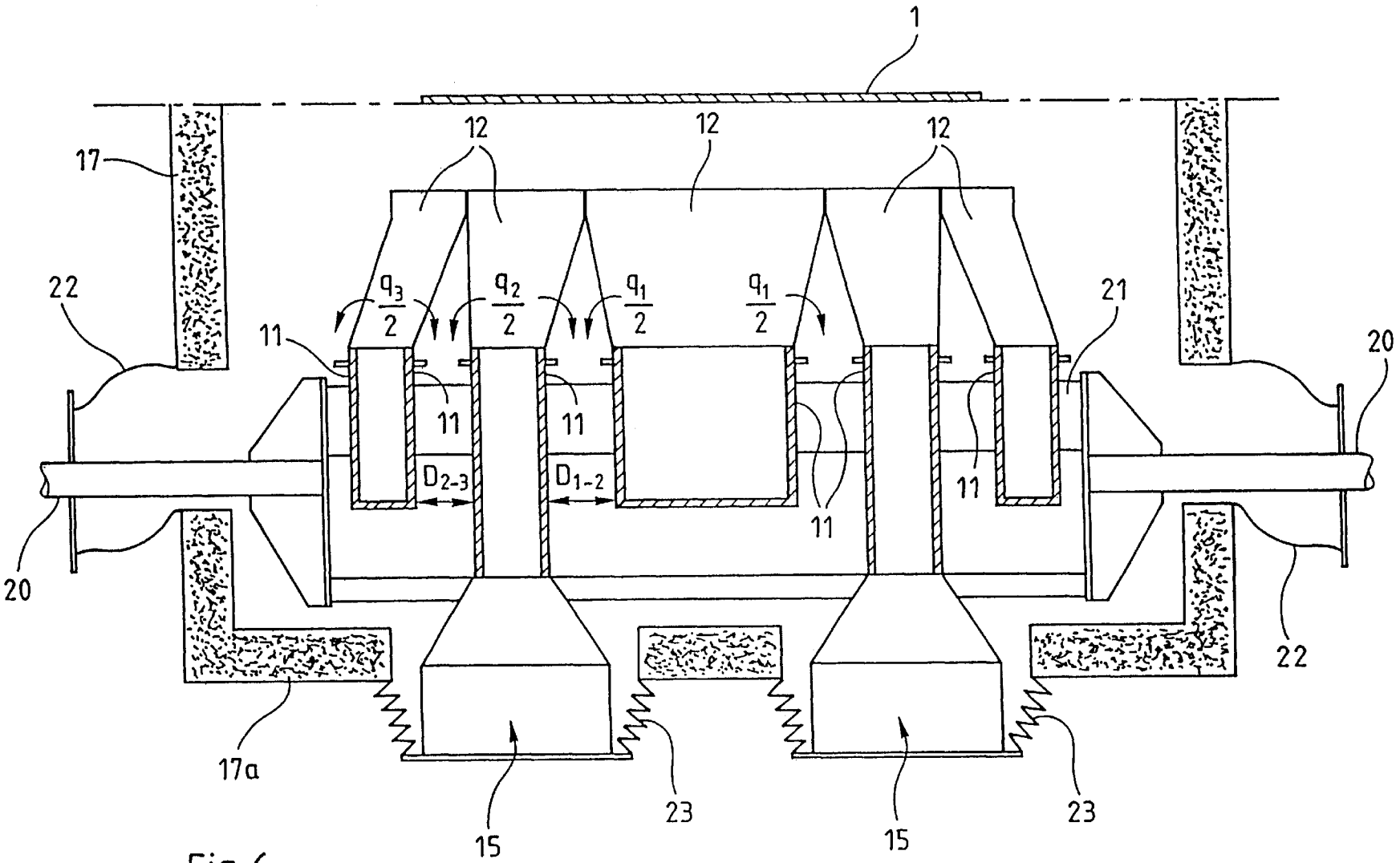
FIG. 6 is a cross-sectional view taken along lines VI—VI of FIG. 5.

Thus, in the example of FIG. 6, $(q1/2+q2/2)/L.D1\text{-}2 \leqq 20$ and $(q2/2+q3/2)/L.D2\text{-}3 \leqq 20$.

When, as in this case, the device has several plenum chambers 11 disposed parallel with one another in the width of the rolled product 1, the section of the space separating the plenum chambers 11 is equal to the sum of the sections of the spaces separating the plenum chambers 11 in pairs.

In this case, by way of non-limitative example, the section would be equal to the sum of the sections, taken from left to right in FIG. 4, L×(D3-4+D2-3+D1-2+D1-2+D2-3+D3-4).

By way of example, the distance L is less than or equal to 300 mm and preferably less than or equal to 150 mm.

In the case in which the blades are symmetrical in their plane (FIG. 3A), the relationship of the type $(q1/2+q2/2)/D1\text{-}2.L \leqq 20$ or $(q1+q2)/D1\text{-}2.L \leqq 40$ is complied with, which makes it possible to fix the spaces between the plenum chambers: $Dij \geqq (qi+qj)/40\ L$, where qi and qj respectively represent the flows (m3/s) of a blade of the plenum chamber i and of the adjacent plenum chamber j, and Dij represents the width (m) of the free space between the plenum chamber i and j.

The blades 12 of each plenum chamber 11 are furthermore distributed regularly over a front face of the plenum chamber 11 in the direction of movement of the rolled product, each blade 12 of a first plenum chamber 11 being adjacent to a blade 12 of a second plenum chamber 11 in the plane defined by the gas outlet orifices 13 (see FIG. 6 in particular).

Thus, although the plenum chambers 11 are spaced from one another in order to facilitate the evacuation of cooling gases, the blades 12 have a profile that is substantially divergent in the transverse plane of the rolled product in such a way as to constitute at their ends, which are all adjacent in this transverse plane, a uniform gas outlet orifice 13 over the whole width of the rolled product 1. The outlet orifice 13 can be formed by a single slot or by a series of small orifices regularly distributed over the whole width of the device.

The width of the gas outlet orifice 13, in the width of the rolled product, is thus greater than the width of the plenum chamber 11.

Furthermore, it is preferable that the ratio between the speed of the gas in a plenum chamber 11 and the speed of the gas at the outlet from the blades 12 integral with the plenum chamber 11 should remain less than 0.2.

Thus, the speed of the gas in each plenum chamber 11 can be of the order of 10 m/s while the speed at the outlet of the blades 12 can reach and exceed 150 m/s.

The plenum chambers 11 thus form reservoirs of gas under pressure and practically without circulation, which makes it possible to obtain a regular flow of gas at the outlet of the blades 12.

Each plenum chamber 11 includes a supply opening 15 for gas under pressure that can be connected to a gaseous pressurizing device such as a fan 16 (see FIG. 1) or a compressor.

The fan 16 is intended to introduce a high flow of cooling gas under pressure into each plenum chamber 11.

The supply openings 15 are disposed in this example in a staggered arrangement in the rear faces of the plenum chambers 11.

The gaseous pressurizing device, in this example, is several fans 16 (see FIG. 1) adapted to supply one or more plenum chambers 11 with gas.

Preferably, when the cooling device 10 embodies, as in this case, an odd number of plenum chambers 11, the gaseous pressurizing device includes one fan 16 adapted to supply the central chamber 11 and at least one other fan 16 adapted to supply plenum chambers 11 disposed symmetrically on either side of the central plenum chamber 11.

In this case, the cooling device 10 can embody three fans, a first fan being connected to the central plenum chamber, a second fan being connected to the intermediate plenum chambers and a third fan being connected to the edge plenum chambers.

These fans are preferably driven by variable speed motors.

It is thus possible to regulate the pressure in the plenum chambers independently in order to ensure the transverse homogeneity of cooling. It is furthermore possible to regulate the cooling intensity over the width of the rolled product 1 according to the desired thermal profile.

Furthermore, if the width of the product to be treated is for example less than or equal to the total width of the central plenum chamber and of the two intermediate plenum chambers, the fan supplying the edge plenum chambers can be stopped or can rotate at idling speed in order to save energy.

As is furthermore shown in FIG. 6, the cooling device 10 is incorporated in a gas-tight enclosure 17, an evacuation orifice 18 (FIG. 5) being provided in a rear wall 17*a* of the enclosure 17, opposite the front face of the plenum chambers 11.

Figure 5:
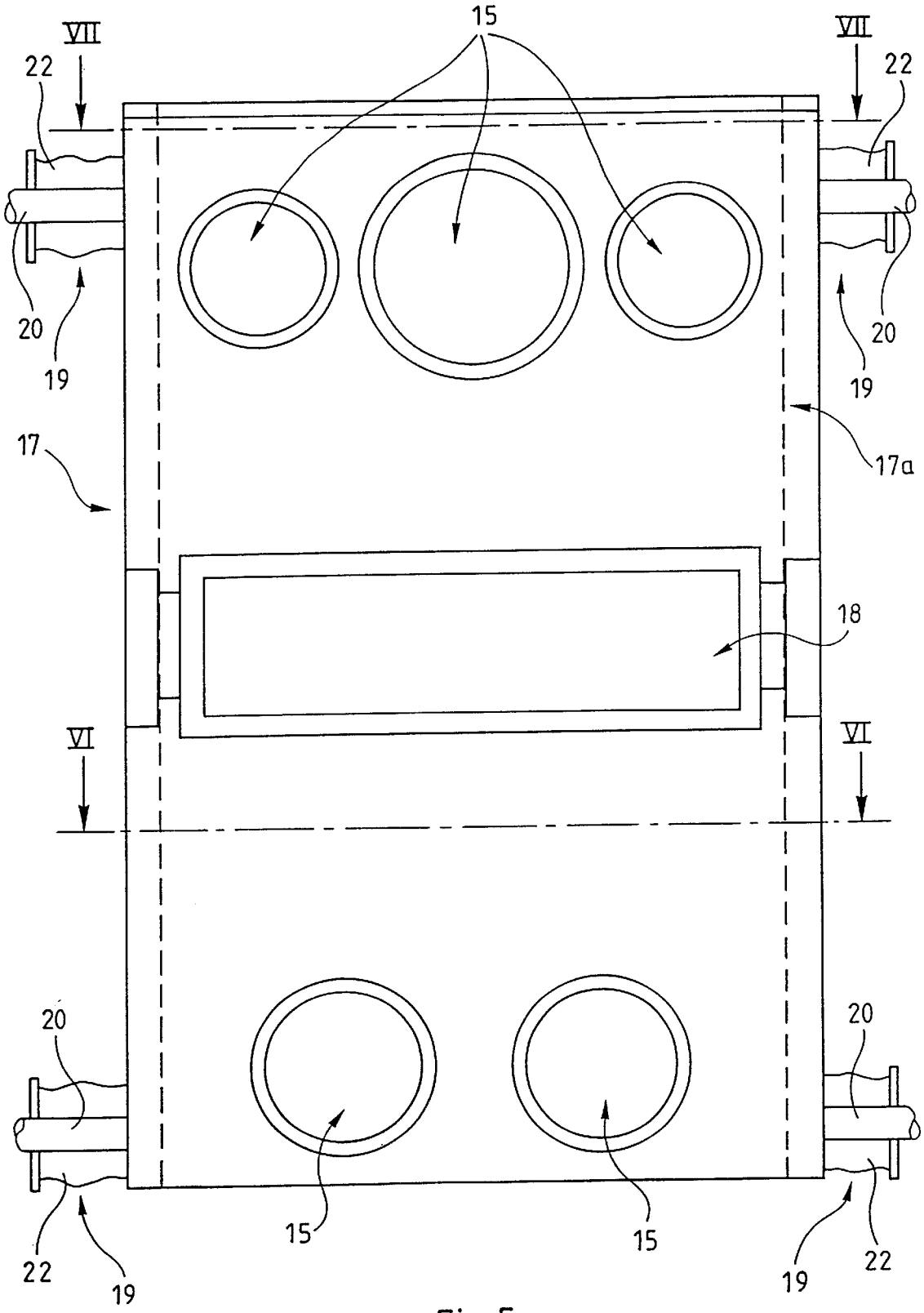
FIG. 5 is a view similar to FIG. 4 of a heat exchanger device placed in a gas-tight enclosure.

The gas evacuation orifice 18 is preferably situated in the center of the rear wall 17*a* of the enclosure 17, at mid-height of the cooling device 10 and substantially has the same width as the latter (FIG. 5).

The gas-tight enclosure 17 can be used in the cases in which, in order to avoid oxidizing the rolled product 1 during its cooling, it is necessary to carry out cooling under a protective atmosphere. For example, when a mixture of nitrogen and hydrogen, with a low hydrogen content, in order to use a reducing but non-explosive gas, is used. The proportion of hydrogen is preferably less than or equal to 5%. The gas could also be pure nitrogen.

The gas can possibly be retrieved at the outlet of the evacuation orifice 18 in order to be recycled continuously in the gaseous pressurizing device. Conventionally, recycling includes a stage for retrieving the gas, a stage for cooling the latter and a stage of re-injecting through the supply openings 15 into the plenum chambers 11.

Figure 7:
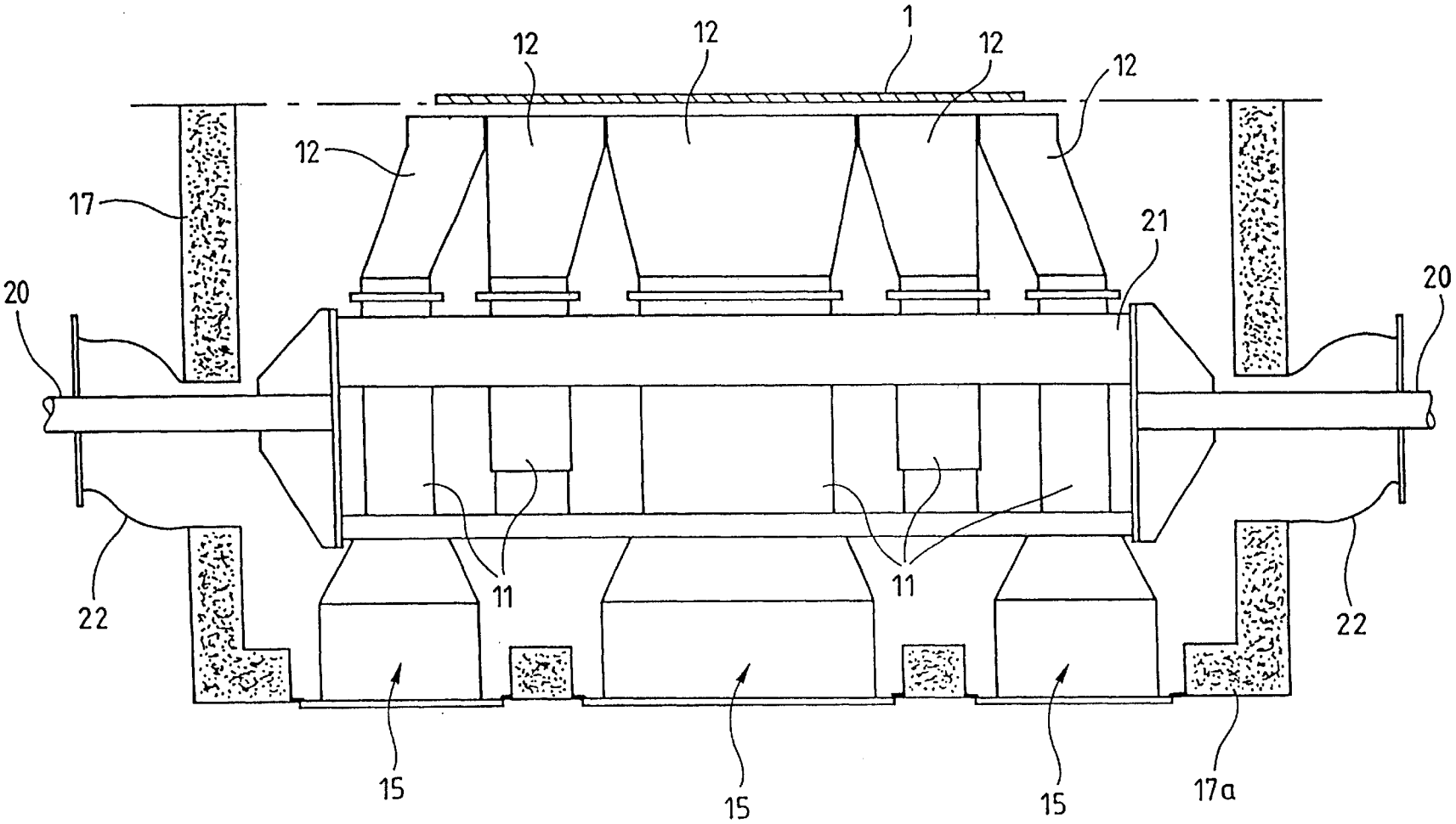
FIG. 7 is a cross-sectional view taken along lines VII—VII of FIG. 5.

As shown in FIGS. 5, 6 and 7, the cooling device 10 preferably includes an adjustment device 19 adapted to displace the cooling device 10 in a direction perpendicular to the rolled product 1.

Thus, the cooling device as a whole can be brought closer to, in a working position illustrated in FIG. 7, or withdrawn from the rolled product 1 as illustrated in FIG. 6.

This distanced position allows, in particular, the cooling device to be moved away from the moving rolled product 1 in the event of an incident, for example when the rolled product is distorted and forms excess thicknesses that could damage the blades 12 of the cooling device 10.

The distance separating the outlet orifices 13 of the blades 12 and the surface of the rolled product can thus be modified in order to adjust the cooling conditions.

The adjustment device 19 can be shafts 20 that are integral with a frame 21 of the device on which the plenum chambers are mounted.

In this case, by way of example, the cooling device 10 includes four shafts 20, disposed in pairs from top to bottom of the cooling device 10, on each side of the device.

Actuating devices (not shown) conventionally make it possible to displace the shafts in a to-and-fro movement in a direction perpendicular to these axes, between the two previously defined positions. The actuating devices can be, for example, motors which are preferably stepper motors, fitted with encoders making it possible to know the orifices-product distance accurately and actuating screw jacks.

When the cooling device 10 is incorporated in a gas-tight enclosure 17 as shown in FIGS. 5 to 7, flexible gas-tight bellows 22 and 23 are provided around the shafts 20 emerging from the gas-tight enclosure 17 in order to be connected to the actuating devices and around the supply openings 15 of the plenum chambers 11 that are connected to the gaseous pressurizing fans 16.

In operation, a steel strip, rolled product 1, moves between the cooling devices 10 disposed in pairs on each side of the steel strip.

Because of the high outlet speed of the gases from the blades, close to 150 m/s, made possible by the retrieval towards the rear of the device, between the plenum chambers 11, of the gas after impact on the strip, it is possible to cool a steel strip efficiently.

By way of example, a steel sheet of width 1300 mm has been cooled from 650 to 400° C., using a gas formed from a mixture of 95% nitrogen and 5% hydrogen, at 45° C.

The cooling device in this test has blades 12 pierced with holes of diameter equal to 9.2 mm forming outlet orifices 13 spaced by 50 mm along the width of the blade 12.

The pitch of the blades 12, or the distance L, is equal to 50 mm and the orifices-strip distance is adjusted to 50 mm.

A central plenum chamber has blades of width equal to 750 mm at the level of the orifices, each blade having fifteen (15) holes.

The lateral plenum chambers have blades of width equal to 300 mm and include six (6) holes.

The depth P of the blades is uniform and equal to 0.35 m, the section S of passage between the blades being equal to 7.3510-3 $m^2$.

The width of passage between the central plenum chamber and the lateral plenum chambers D1-2 is equal to 150 mm.

The gas flow per $m^2$ of exchange area on the steel sheet to be cooled reaches 250 m3/$m^2$.min.x side.

In this way an escape speed of the gas between the blades equal to 10.63 m/s is obtained and, between the central and lateral plenum chambers, a speed of 14.6 m/s is obtained.

In this way, a mean transfer coefficient of 623 Kcal/$m^2$.h.° C. is obtained with a mean cooling speed between 650 and 400° C. of 120° C./s for 1 mm of thickness.

It is therefore stated that the cooling device according to the invention makes it possible to achieve flows per unit area that are distinctly higher than in conventional devices, without observing saturation and with higher efficiencies.

It is appropriate to comment that, in the above description, the return gas flows are considered as equal to the injected gas flows, whereas the gas, heating up on contact with the product to be cooled, expands.

The flows, however, are large and the heating up is minor such that the increase in speed due to the heating can be ignored.

The calculation of speeds can therefore be carried out by dividing the return flows in m3/s, which are equal to the injected flows in m3/s, by the section in $m^2$.

The invention is not of course limited to the embodiment described above and numerous modifications can be applied to it without departing from the scope of the invention.

Thus, the number of plenum chambers, equal to five, can be different while preferably remaining odd.

Furthermore, the heat exchanger device could be a heating device instead of a cooling device.

What is claimed is:

1. A heat exchanger device for exchanging heat with a flat product moving in front of said device, said device comprising:

at least one plenum chamber; and means for placing said at least one plenum chamber under gaseous pressure;

said at least one plenum chamber comprising a front face with a plurality of blades extending therefrom, said plurality of blades defining a duct for the ejection of gas towards said flat product, said plurality of blades being superimposed upon one another in the direction of movement of said flat product, said plurality of blades defining outlet orifices for said gas, said outlet orifices extending in the direction of the width of said flat product, said at least one plenum chamber having a width in the direction of the width of said flat product allowing the evacuation of said gas towards the rear of said device on at least one side of said at least one plenum chamber, the width of said at least one plenum chamber being less than the width of said outlet orifices.

2. A heat exchanger device according to claim 1, wherein said at least one plenum chamber comprises a rear face disposed opposite said front face of said at least one plenum chamber, said at least one plenum chamber further comprising openings for the outlet of said gas after ejection, said openings being situated in a plane defined by said rear face.

3. A heat exchanger device according to claim 1, wherein said at least one plenum chamber comprises at least two plenum chambers disposed in the width of said flat product, the spacing between said at least two plenum chambers being such that the evacuation of said gas between said at least two plenum chambers is carried out at a speed of less than or equal to 20 m/s.

4. A heat exchanger device according to claim 3, wherein the ratio between half of the flowrate of said gas at said outlet orifices of two adjacent blades of said plurality of blades to a cross-sectional area of space between said at least two plenum chambers comprising said plurality of blades is less than 20, said cross-sectional area extending in a plane parallel with said flat product and extending in the direction of movement of said flat product.

5. A heat exchanger device according to claim 4, wherein said at least two plenum chambers comprise a plurality of plenum chambers disposed parallel with one another in the direction of the width of said flat product, said cross-sectional area being equal to the sum of the cross-sectional areas of the spaces between said at least two plenum chambers in pairs.

6. A heat exchanger device according to claim 3, wherein said plurality of blades of said at least two plenum chambers are distributed regularly over said front face of said at least two plenum chambers in the direction of movement of said flat product, each blade of said plurality of blades of one of said at least two plenum chambers being disposed correspondingly adjacent to each blade of said plurality of blades of another of said at least two plenum chambers in the plane defined by said outlet orifices.

7. A heat exchanger device according to claim 5, wherein said plurality of blades are dimensioned such that the evacuation of said gas in said cross-sectional areas between said blades of said plurality of blades is carried out at a speed of less than or equal to 20 m/s at all points.

8. A heat exchanger device according to claim 7, wherein $P(x) \geqq (q)(x)/20(l)(w)$, where P(x) is the depth of each blade of said plurality of blades at a distance x from an axis of symmetry or from a blade end, w is the mean free height between two blades of said plurality of blades, q is the flow per each blade of said plurality of blades, l is the width of the end of each blade of said plurality of blades, and where $x \leqq ½$ in the case which the return of said gas is carried out on both sides of each blade of said plurality of blades, and $x \leqq 1$ in the case in which the return of said gas is carried out on only one side of each blade of said plurality of blades.

9. A heat exchanger device according to claim 1, wherein the ratio between the speed of said gas in one of said at least one plenum chamber and the speed of said gas at said outlet orifices of said plurality of blades integral with said at least one plenum chamber is less than 0.2.

10. A heat exchanger device according to claim 1, wherein said means for placing said at least one plenum chamber under gaseous pressure comprises a plurality of fans adapted to supply gas to one or more of said at least one plenum chamber.

11. A heat exchanger device according to claim 10, wherein said at least one plenum chamber comprises an odd number of plenum chambers, said odd number of plenum chambers comprising at least one central plenum chamber and other plenum chambers, said means for placing said at least one plenum chamber under gaseous pressure comprising one fan adapted to supply said central plenum chamber, and said means for placing said at least one plenum chamber under gaseous pressure further comprising at least one other fan adapted to supply said other plenum chambers disposed symmetrically on either side of said at least one central plenum chamber.

12. A heat exchanger device according to claim 1, further comprising:

a gas-tight enclosure having a rear wall;

an evacuation orifice provided in said rear wall of said gas-tight enclosure opposite said front face of said at least one plenum chamber.

13. A heat exchanger device according to claim 1, further comprising means for adjustment adapted to displace said device in a direction perpendicular to said flat product.

14. A cooling device for a flat rolled steel product formed from said heat exchanger device according to claim 1.

* * * * *

UNITED STATES PATENT AND TRADEMARK OFFICE

CERTIFICATE OF CORRECTION

PATENT NO. : 6,358,465 B1
DATED : March 19, 2002
INVENTOR(S) : Phillippe Paulus

It is certified that error appears in the above-identified patent and that said Letters Patent is hereby corrected as shown below:

Title page,
Item [74], delete "Vanophem & Vanophem", and insert -- VanOphem & VanOphem --.

Column 1,
Line 19, after "C", kindly delete the period ".".

Column 8,
Line 62, after "C", kindly delete the period ".".
Line 63, after "400º C", kindly delete the period ".".
Line 63, after "120º C", kindly delete the period ".".

Signed and Sealed this

First Day of April, 2003

JAMES E. ROGAN
*Director of the United States Patent and Trademark Office*